United States Patent [19]

Taoka et al.

[11] Patent Number: 4,755,784

[45] Date of Patent: Jul. 5, 1988

[54] CHIP INDUCTOR

[75] Inventors: Mikio Taoka, Neyagawa; Hiromasa Yamamoto, Toyonaka; Hiroshi Otake, Katano; Hironori Arima, Hirakata, all of Japan

[73] Assignee: Matsushita Electric Industrial Co., Ltd., Osaka, Japan

[21] Appl. No.: 879,889

[22] Filed: Jun. 30, 1986

[30] Foreign Application Priority Data

Jul. 2, 1985 [JP] Japan ..... 60-145563

[51] Int. Cl.[4] ..... H01F 27/02; H01F 7/06

[52] U.S. Cl. ..... 336/96; 336/65; 336/192; 29/605; 29/855

[58] Field of Search ..... 336/192, 65, 96; 29/605, 854, 855, 856

[56] References Cited

U.S. PATENT DOCUMENTS

| | | | |
|---|---|---|---|
| 2,486,751 | 11/1949 | McMichael | 336/192 |
| 3,343,113 | 9/1967 | Dougall | 336/192 |
| 3,457,534 | 7/1969 | Davis | 336/192 |
| 3,910,666 | 10/1975 | McIntosh | 336/192 |
| 4,427,961 | 1/1984 | Suzuki | 336/83 |
| 4,553,123 | 11/1985 | Tamada et al. | 336/192 |

FOREIGN PATENT DOCUMENTS

| | | | |
|---|---|---|---|
| 1949413 | 1/1971 | Fed. Rep. of Germany . | |
| 1539757 | 5/1971 | Fed. Rep. of Germany . | |
| 56-617 | 4/1980 | Japan | 29/605 |
| 647926 | 2/1985 | Switzerland . | |

OTHER PUBLICATIONS

Patents Abstracts of Japan, vol. 9, No. 169 (E-328) [1892], Jul. 13, 1985; & JP-A-60 43 805 (Matsushita Denki Sangyo K.K.) 08-03-1985 (Cat. A)* Abstract*.

Patents Abstracts of Japan, vol. 8, No. 74 (E-236) [1511], Apr. 6, 1984; & JP-A-58 223 306 (Toukou K.K.) 24-12-1983, *Abstract*.

*Primary Examiner*—P. W. Echols

*Attorney, Agent, or Firm*—Stevens, Davis, Miller & Mosher

[57] ABSTRACT

A leadless chip inductor having metallic terminal plates and a coil element fixed to the metallic terminal plates, the metallic terminal plates being partially enclosed, together with the coil element, by a resin molded cover, the portions of the metallic terminal plates exposed to the outside of the molded outer cover being bent along the edge of the molded cover so as to form terminals for connection to an external circuit. The mechanical and electrical connection between the metallic terminal plates and the lead lines led from the coil is achieved by brazing or welding the lead lines to the undersides of a narrow strip-shaped tabs which is projected from each metallic terminal plate. With this arrangement, the coil lead lines are securely connected to the metallic terminal plates.

4 Claims, 6 Drawing Sheets

CHIP INDUCTOR

BACKGROUND OF THE INVENTION

1. Field of the Invention

The present invention relates to a leadless chip inductor for use in various electronic devices, and also to a method of producing such a chip inductor.

2. Description of the Related Art

In recent years, there is a trend for reduction in the sizes of electronic devices, as a result of progress in the technology for the production of various electronic parts including semiconductors in the form of leadless chips.

On the other hand, the requirement for higher relaibility of these leadless chip parts is becoming more senere due to current progress in related technologies such as high-density packaging, reflow brazing and so forth, as well as diversification of function of the electronic devices.

A typical conventional chip inductor will be explained hereinunder with reference to the drawings.

Referring first to FIG. 1 which is a transparent perspective view of a chip inductor, a coil element is constituted by winding a coil 12 on a magnetic core 11 such as a drum-shaped core. This coil element is fixed to the upper surfaces of a pair of metallic terminal plates 13. Coil lead lines 14 are connected mechanically and electrically to the upper surfaces of the metallic terminal plates 13 by brazing or welding as at 15. A molded cover encloses a major part of the metallic terminal plates 13 including the connections 15 and coil element. The portions of the metallic terminal plates 13 outside the molded cover are suitably shaped by, for example, bending in conformity with the manner of packaging of the electronic devices on which the chip inductor is to be mounted.

The chip inductor having the described construction exhibits superior electric characteristics because the influence of the metallic terminal plates 13 on the magnetic field produced by the coil core 11 is reduced. On the other hand, however, this chip inductor suffers a problem that the position of the electric and mechanical connection between the coil lead lines 14 and the upper surfaces of the metallic terminal plates 13 are fluctuated undesirably, with a result that the reliability of the connection is impaired particularly when the chip inductor is mass-produced. This problem will be explained in more detail with reference to FIG. 2.

FIG. 2 illustrates the manner in which coil lead lines 14 are connected to the metallic terminal plates 13. The coil lead lines 14 led from the coil 12 on the coil core 11 are wound around fixing pins 17 provided on a coil winding device or a coil winding jig. Numeral 18 designate electrodes for electrically and mechanically connecting the coil lead lines 14 to the metallic terminal plate 13. In operation, after the ends of the coil lead lines 14 are wound around the fixing pins 17, the connecting electrodes 18 are pressed onto the metallic terminal plates 13 through the intermediary of the coil lead lines 14. During the pressing, the fixing pins 17 are allowed to move so as to slack the coil lead lines 14, in order to avoid cutting of the coil lead lines 14. The connection is conducted by brazing or welding.

The number of turns of the coil winding, as well as the kind of the wire material, has to be changed to meet various demands for coil performance and characteristics. Namely, the specifications of the chip inductor vary depending on uses and other factors. This inconveniently causes a variation in the positions from which the coil lead lines 14 are led from the coil 12. In addition, the coil lead lines 14 have to be slacked during pressing as explained before. This results in fluctuation or variation of the positions at which the coil lead lines 14 are connected to the metallic terminal plates.

Another problem encountered with the conventional chip inductor is that breakaway of the coil lead lines 14 tends to occur at portions where the lines are connected to the metallic terminal plates, when a tension is applied to the lead lines which are laid along the surfaces of the metallic terminal plates. This is attributable to the fact that the stress is concentrated to a sole point on each coil lead line 14 where it is connected to the metallic electrode plate.

SUMMARY OF THE INVENTION

Accordingly, an object of the invention is to provide a chip inductor having a high reliability, thereby overcoming the above-described problems of the prior art.

To this end, according to the invention, there is provided a chip inductor having metallic terminal plates, a coil element connected to the metallic terminal plates, and a molded cover enclosing the metallic terminal plates and the coil element, portions of the metallic terminal plates exposed to the outside of the molded cover being bent along the edges of the molded cover, wherein the improvement comprises narrow strip-shaped tabs projected from respective metallic terminal plates, the coil element being fixed to the upper surfaces of the opposing ends of the pair of metallic terminal plates in a manner like a bridge, the coil lead lines extended from the coil element being connected to the metallic terminal plate by being fixed to the undersides of the tabs.

With this arrangement, it becomes possible to fix the coil lead lines to the undersides of the tabs of the terminals, regardless of the coil specifications, so that the electric and mechanical connection between the coil lead lines and the metallic terminal plates can be conducted stably without fluctuation even in mass-production of the chip inductor. A higher stabilizing effect will be produced by forming notches in the tabs of the terminal plates, such that the coil lead lines are caught and fixed in the notches.

In addition, since the electric and mechanical connection is made to the underside of the terminal plate, any tension applied to the coil lead line acts to pull the portion of the lead line extending along and bonded to the end surface of the terminal plate, so that the tension is born by the entire length of the bonded portion, thus improving the reliability through elimination of risk of breakaway of the coil lead line attributable to tension.

DESCRIPTION OF THE PREFERRED EMBODIMENTS

A preferred embodiment of the invention will be described hereinunder with reference to the accompanying drawings.

Figure 1:
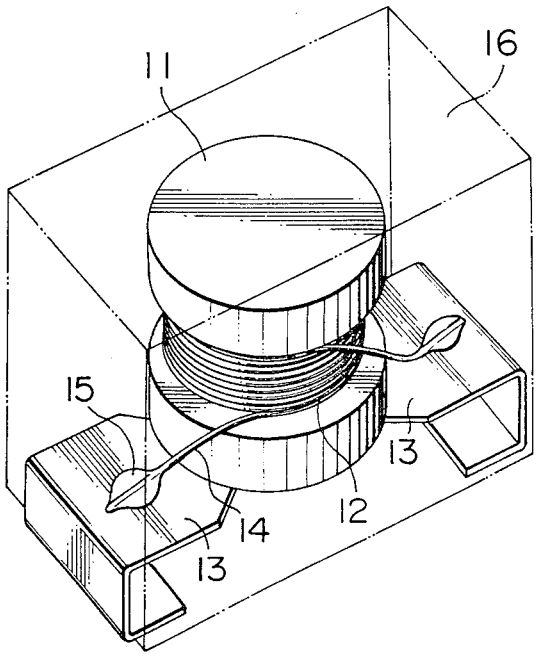
FIG. 1 is a transparent perspective view of a known chip inductor.
Figure 2:
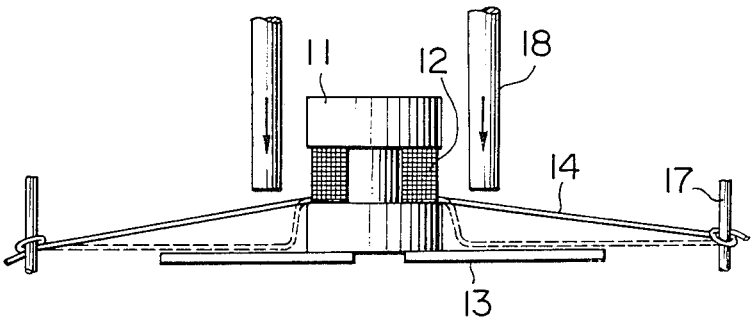
FIG. 2 is an illustration of the manner in which the coil lead lines are connected to metallic terminal plates mechanically and electrically.
Figure 3:
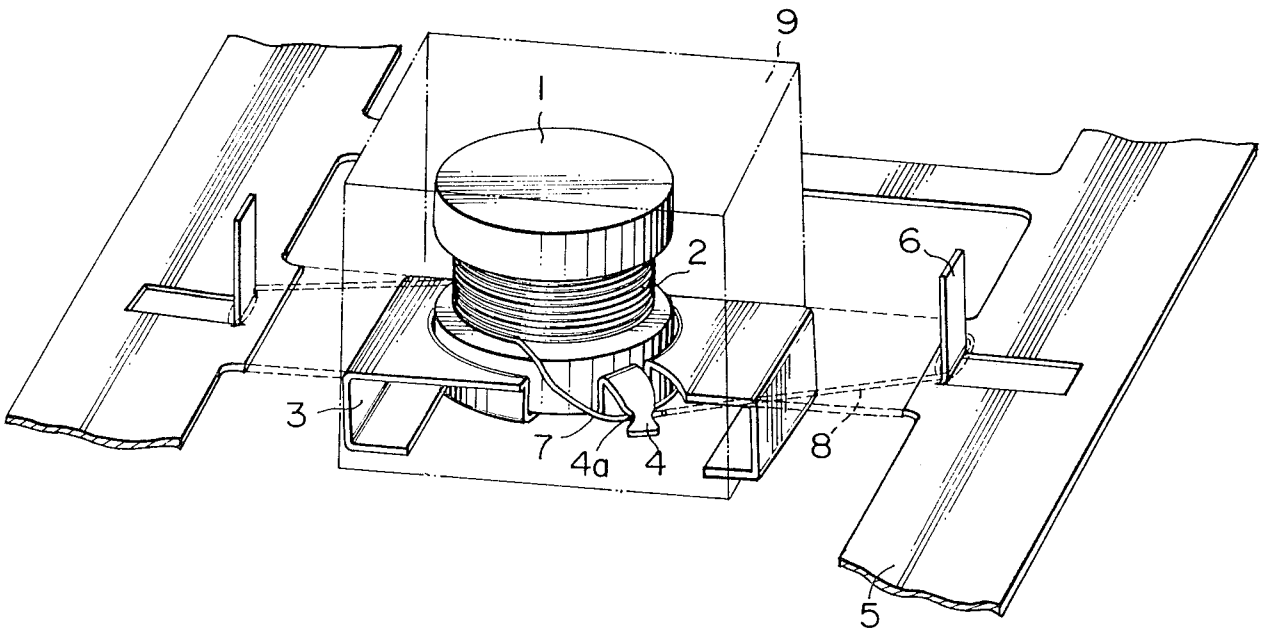
FIG. 3 is a transparent perspective view of an embodiment of the chip inductor in accordance with the present invention.
Figure 4:
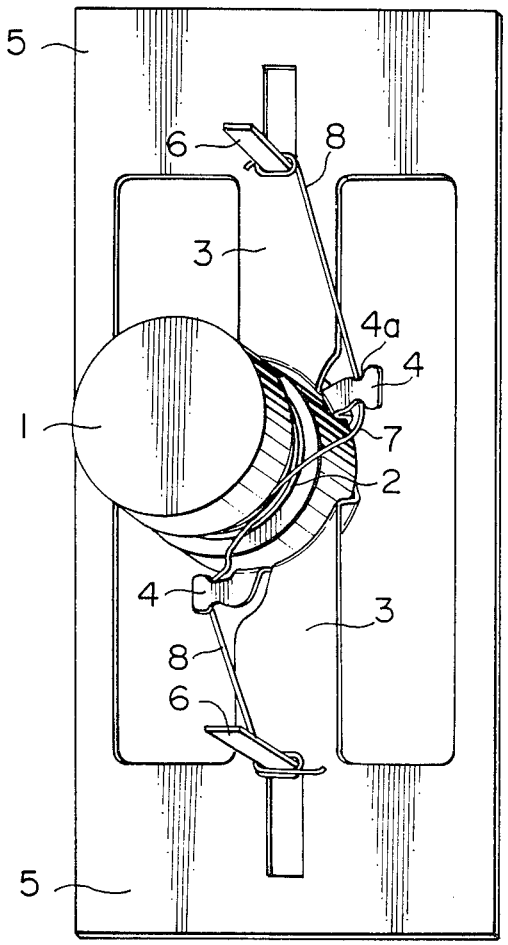
FIG. 4 is a perspective view of a chip inductor shown in FIG. 3 in the state before it is enclosed by a molded cover.

FIG. 3 is a transparent perspective view of a preferred embodiment of a chip inductor in accordance with the invention, while FIG. 4 is a perspective view of the chip inductor in the course of assembly, with a molded cover omitted. For the sake of convenience, the chip inductor shown in FIG. 3 is already provided with a portion of the terminal frame which will be explained later.

Referring to FIGS. 3 and 4, a reference numeral 1 designates a coil core such as a drum-shaped core, on which is wound a coil 2 thus completing a coil element. The coil element is fixed to the upper surfaces of a pair of metallic terminal plates 3 in a manner like a bridge by, for example, an adhesive. A narrow strip-like tab 4 is projected laterally from the end of each metallic terminal plate 3, and each coil lead line 7 is extended along the underside, i.e., the surface opposite to the coil element, of the tab 4. Preferably, the tab 4 is provided with a notch 4*a* for receiving and catching the coil lead line 7. This arrangement further stabilizes the position of the coil lead line 7. For the purpose of temporarily fixing the coil lead lines along the underside of the respective tabs 4, the free end portions of the coil lead lines 7 are wound on projections 6 which are disposed on the central axis of the metallic terminal plates 3 on the opposite side of each terminal plate 3 to the coil element.

The mechanical and electrical connection between each coil lead line 7 and the metallic terminal plate 3 is accomplished by fixing each coil lead line 7 to the underside of each tab 4 by brazing or welding. Then, the unnecessary end portion 8 of each coil lead line between the tab 4 and the projection 6 is removed by cutting. Subsequently, the portions of the metallic terminal plates 3 carrying the coil element and the tabs 4 are covered by a molded cover 9, and the portions of the metallic terminal plates 3 exposed to the outside of the molded cover are suitably formed by, for example, bending or cutting at a suitable length, so as to constitute coil terminals.

Practically, the chip inductor in accordance with the invention can be produced by arraying a pair of metallic terminal plates 3 in a fixed relation to each other through the aid of a terminal frame 5. When the chip inductors are to be mass-produced, a multiplicity of metallic terminal plates 3 are arrayed in a row and are held by the terminal frame 5, so as to facilitate continuous production of the chip inductors.

Although in the described embodiment the coil core 1 is fixed to the metallic terminal plate 3 after the winding of the coil 2 thereon, this is not exclusive and the process may be such that the coil winding is effected after fixing the coil core 1 to the metallic terminal plates 3. The assembly process including the coil winding can be conducted automatically and at a high efficiency, if the process is conducted by a series of steps which includes temporary fixing of the lead line of the winding starting end, winding of the coil and temporary fixing of the terminating end lead line. Such an automatic assembly process enables a high yield when used in a mass-production of the chip inductors.

It is advisable that, in advance of fixing of the coil element (or coil core) to the metallic terminal plate 3, the metallic terminal plates 3 are bent to form a recess in conformity with the shape of the coil element, such that the coil element or the coil core is stably seated in the recess. With this arrangement, it is possible to stabilize the position of the coil element and to prevent the adhesive for fixing the coil element or core to the metallic terminal plate from flowing along the metallic terminal plate. It is thus possible to improve the bonding strength and to avoid any unfavorable effect on the mechanical and electrical connection which would otherwise be caused by the flowing of the adhesive towards the tabs 4 of the metallic terminal plates.

In a modification of the described embodiment, the coil lead line 7 is wound one to several times around each narrow tab 4 on each metallic terminal plate 3 so as to be fixed mechanically and then electrically connected by brazing or welding to the underside of the tab 4.

Figure 5A:
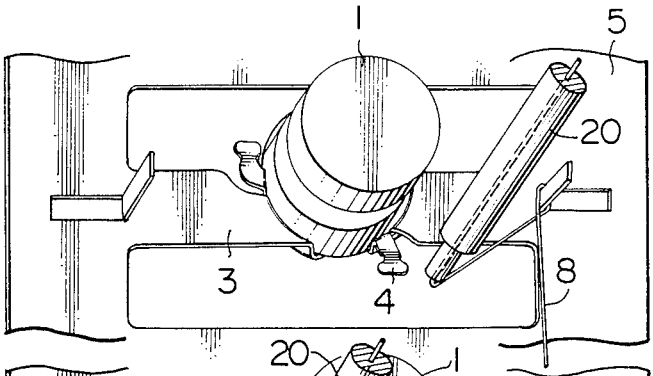
FIGS. 5*a* to 5*d* are perspective views illustrating successive steps of an embodiment of the process of the invention for fabricating a chip inductor.
Figure 5B:
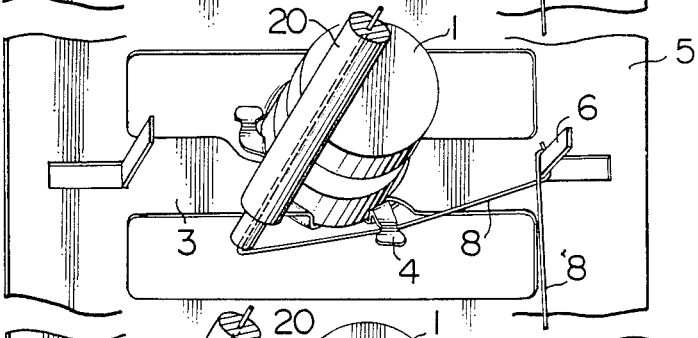
Figure 5C:
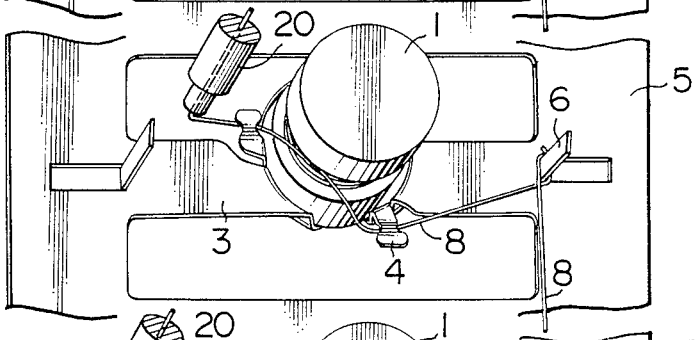
Figure 5D:
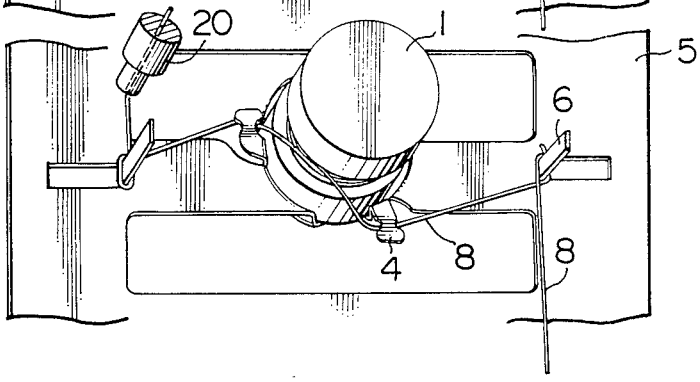
Figure 6:
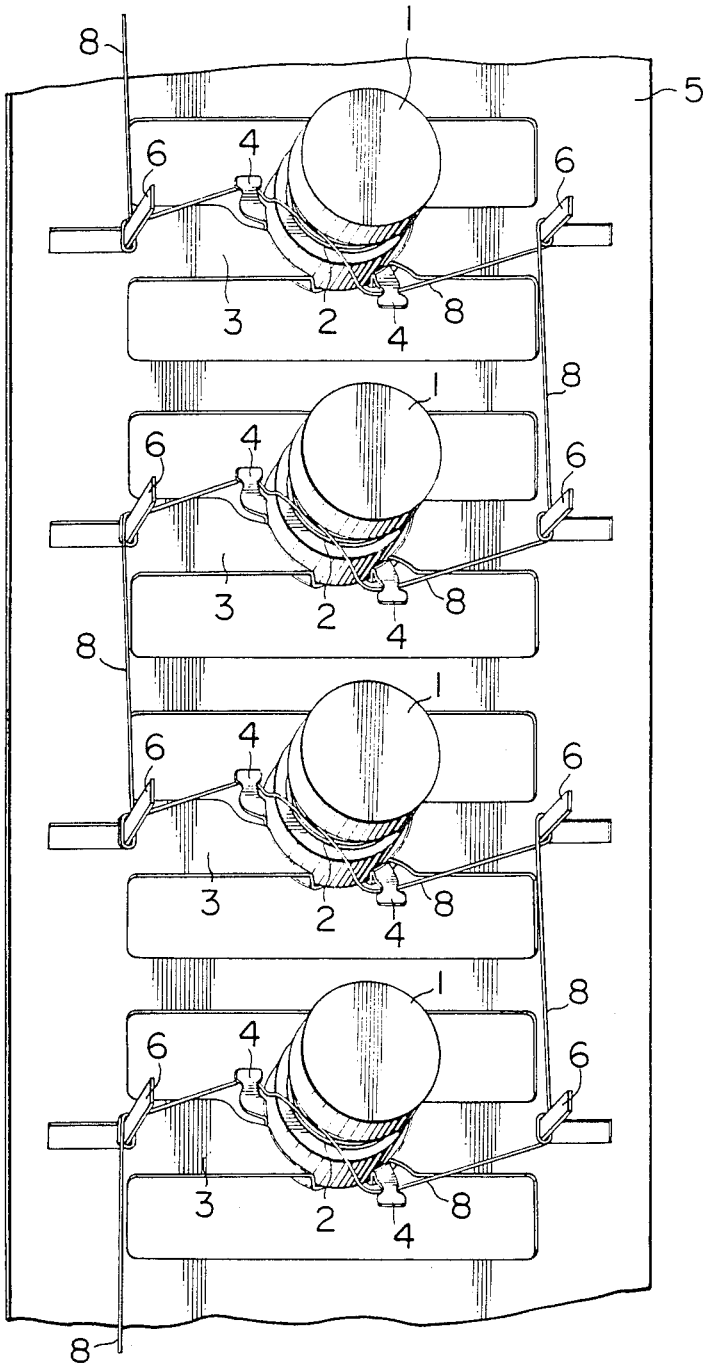
FIG. 6 is a perspective view of a chip inductor in the state after winding of the coil.

A description will be made hereinunder as to the method of the invention for producing a chip inductor, with specific reference to FIGS. 5*a* to 7. In these Figures, a reference numeral 20 designates a nozzle of a coil winding machine. A copper wire to be wound is continuously extracted from a central port of this nozzle. FIG. 5*a* shows a state in which the copper wire is wound on and temporarily fixed by one of the projections 6. The nozzle 20 is then moved such that the copper wire is laid and fixed along the underside of the projection 4, as shown in FIG. 5*b*. In this state, the nozzle 20 is rotated about the coil core 1 along a coil groove formed in the outer surface of the latter, thus forming the coil. After the completion of the coil winding by a predetermined number of turns, the copper wire is extended along the underside of the other tab 4 as shown in FIG. 5*c* and then wound on and fixed by a projection 6 as shown in FIG. 5*d*. FIG. 6 shows chip inductors in the state after the winding of the coils. It will be seen that a plurality of pairs of metallic terminal plates are arranged in a row and are held together by a terminal plate frame 5. With this arrangement, it is possible to mass-produce the chip inductors, by winding the wire on successive cores 1 by means of a single winding machine.

Figure 7:
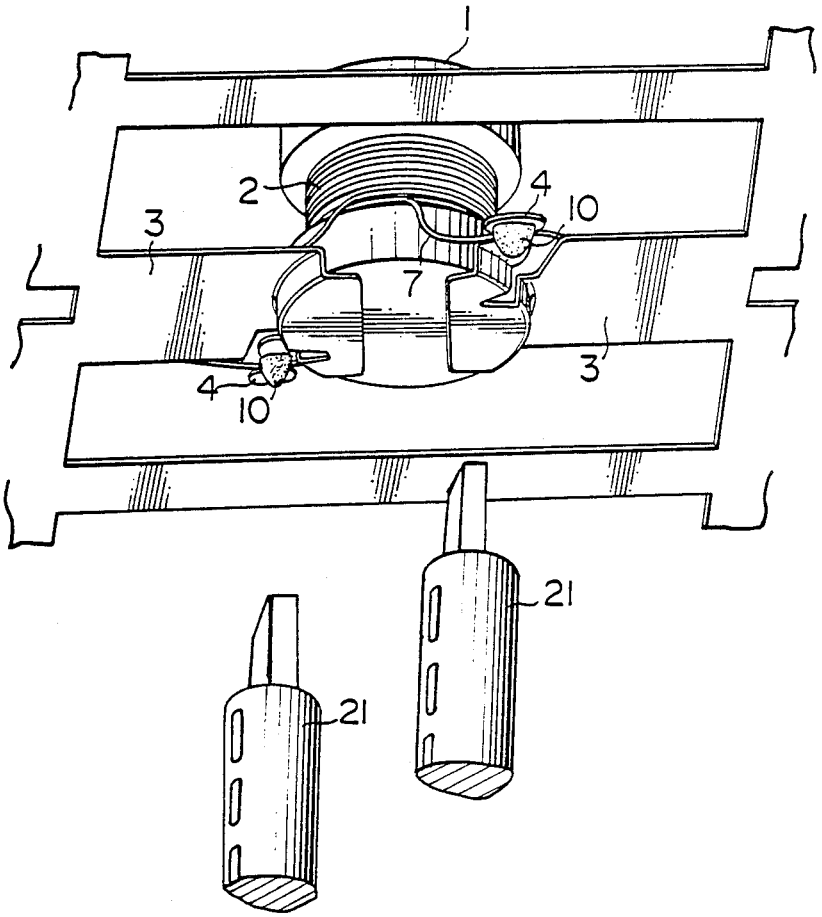
FIG. 7 is a perspective view illustrating the state in which the coil lead lines are connected to the metallic terminal plates.

FIG. 7 shows the manner in which the lead lines of the coil 2 wound on the coil core 1 are connected to the metallic terminal plates 3. The connection is conducted by fixing the coil lead lines to the undersides of the tabs 4 projected from respective metallic terminal plates 3. A brazing material 10 in the form of a cream is applied by means of a dispenser or a pin transfer, and is fused by, for example, a brazing iron 21, so as to braze each coil lead line to the tab 4 of the corresponding metallic terminal plate 3. Thereafter, the unnecessary portion 8 of the coil lead line 7 is removed by cutting. Then, after covering the coil element and the portion of the metallic terminal plates 3 including the tabs 4 by molding with an epoxy resin, the metallic terminal plates 3 are severed from the metallic terminal frame 5. Then, the metallic terminal plates 3 are bent along the edges of the molded cover 9, thus completing the fabrication of the chip inductor.

As has been described, in the method of the invention for producing a chip inductor, a coil element is mounted on the upper surfaces of the opposing ends of a pair of metallic terminal plates in a manner like a bridge, and the lead lines which are led from the coil are laid along the undersides of narrow strip-like tabs extended from the metallic terminal plates and electrically connected to the undersides of the tabs. The coil element and the portions of the metallic terminal plates including the tabs are then enclosed by a molded cover. The portions of the metallic terminal plates exposed to the outside of the molded cover are then suitably processed to form terminals for connection to an external circuit.

This production method offers the following advantages. Firstly, it is to be noted that fluctuation in the positions of the electric connection between the coil lead lines and the metallic terminal plates is avoided to enable a stable connection even in the mass-production of the chip inductor, regardless of the coil specifications. Secondly, even when a tensile stress is applied to the coil lead lines due to, for example, during resin molding, such a tensile stress can be born safely because such a tensile stress acts to pull the portion of each coil lead line which extends in contact with the end surface of each metallic terminal plate.

Thirdly, the described method of the invention enables an easy mass-production of the chip inductors, while achieving a high reliability of the products, by automation of a series of steps through the use of a metallic terminal plate frame which holds and feeds successive metallic terminal plates in a row.

What is claimed is:

1. A chip inductor having opposing metallic terminal plates, a coil element connected to said metallic terminal plates, and a molded cover partially enclosing said metallic terminal plates and fully enclosing said coil element, portions of said metallic terminal plates exposed to the outside of said molded cover being bent along the edges of said molded cover, wherein the improvement comprises narrow strip-shaped tabs projected from respective metallic terminal plates, said coil element being fixed to the upper surfaces of opposing ends of said pair of metallic terminal plates so as to bridge the plates, coil lead lines extending from said coil element being connected to said metallic terminal plates by being fixed to the undersides of said tabs, wherein each of said tabs is provided with a notch which receives and catches said coil lead line which is to be laid on and fixed to the underside of said tab.

2. A chip inductor according to claim 1, wherein the opposing ends of said pair of metallic terminal plates are bent in such a manner as to form a recess which conforms with the shape of said coil element, and said coil element is seated and fixed in said recess.

3. A chip inductor according to claim 1, wherein each of said coil lead lines in wound one to several times around said tab before it is fixed to the underside of said tab.

4. A chip inductor, comprising:

a pair of opposing metallic terminal plates, a coil element fixed to upper surfaces of opposing ends of said pair of metallic terminal plates so as to bridge said metallic terminal plates, a plurality of tabs each having a narrower width than the width of said opposing ends of said metallic terminal plates and including concave-shaped notches, coil lead lines extending from said coil element and engaging said concave-shaped notches, said coil lead lines being fixed to said metallic terminal plates and extending along undersides of said tabs, said coil lead lines being electrically connected to said metallic terminal plates at said undersides of said tabs, and a molded cover fully enclosing said coil element and said tabs and partially enclosing said metallic terminal plates, portions of said metallic terminal plates being exposed to the outside of said molded cover to provide terminals for electrically connecting said coil element to external circuits.

* * * * *